US009160044B2

(12) United States Patent
Kawamura et al.

(10) Patent No.: US 9,160,044 B2
(45) Date of Patent: Oct. 13, 2015

(54) MILLIMETER WAVEBAND FILTER AND METHOD OF MANUFACTURING THE SAME

(71) Applicant: ANRITSU CORPORATION, Kanagawa (JP)

(72) Inventors: Takashi Kawamura, Kanagawa (JP); Akihito Otani, Kanagawa (JP); Hiroshi Hasegawa, Kanagawa (JP)

(73) Assignee: ANRITSU CORPORATION, Kanagawa (JP)

( * ) Notice: Subject to any disclaimer, the term of this patent is extended or adjusted under 35 U.S.C. 154(b) by 395 days.

(21) Appl. No.: 13/893,473

(22) Filed: May 14, 2013

(65) Prior Publication Data

US 2013/0314179 A1 Nov. 28, 2013

(30) Foreign Application Priority Data

May 23, 2012 (JP) ..... 2012-117448

(51) Int. Cl.
*H01P 1/201* (2006.01)
*H01P 1/207* (2006.01)
*H01P 5/02* (2006.01)

(52) U.S. Cl.
CPC ..... *H01P 1/201* (2013.01); *H01P 1/207* (2013.01); *H01P 5/024* (2013.01)

(58) Field of Classification Search
CPC ..... H01P 1/201; H01P 1/207
USPC ..... 333/208, 209
See application file for complete search history.

(56) References Cited

U.S. PATENT DOCUMENTS

| | | | | |
|---|---|---|---|---|
| 3,675,165 | A * | 7/1972 | Ueda et al. | 333/252 |
| 8,149,073 | B2 * | 4/2012 | Nakagawa | 333/209 |
| 2003/0006866 | A1 * | 1/2003 | Yoneda et al. | 333/212 |

OTHER PUBLICATIONS

Tasuku Teshirogo and Tsukasa Yoneyama eds. "Modern Millimeter-Wave Technologies" In: Wave Summit Course, 2001 pp. 68-69.

* cited by examiner

*Primary Examiner* — Stephen E Jones
*Assistant Examiner* — Erfan Faneian
(74) *Attorney, Agent, or Firm* — Pearne & Gordon LLP

(57) ABSTRACT

A transmission line which allows electromagnetic waves in a predetermined frequency range of a millimeter waveband to propagate in a TE10 models formed by a first waveguide and a second waveguide. A resonator is formed by electric wave half mirrors fixed to the first waveguide and the second waveguide. The second waveguide has a structure in which a first transmission line forming body has a plate shape and has a square hole forming the first transmission line formed to pass therethrough from one surface toward an opposite surface, a second transmission line forming body has a plate shape and has a square hole forming the second transmission line formed to pass therethrough from one surface toward an opposite surface, and the first transmission line forming body and the second transmission line forming body are connectable and separable.

4 Claims, 7 Drawing Sheets

| | NO GAP | GAP 20μm, GROOVE | GAP 20μm, NO GROOVE |
|---|---|---|---|
| CENTER FREQUENCY (GHz) | 133.523 | 133.118 | 133.243 |
| INSERTION LOSS (dB) | 2.34 | 3.67 | 19.19 |
| 3 dB BANDWIDTH (GHz) | 0.280 | 0.343 | 0.964 |
| Q | 477 | 388 | 138 |

$S_{21}$ FREQUENCY CHARACTERISTIC

MILLIMETER WAVEBAND FILTER AND METHOD OF MANUFACTURING THE SAME

TECHNICAL FIELD

The present invention relates to a filter which is used in a millimeter waveband.

BACKGROUND ART

In recent years, there is an increasing need for the use of electric waves in response to a ubiquitous network society, and a wireless personal area network (WPAN) which realizes wireless broadband at home or a millimeter waveband wireless system, such as a millimeter-wave radar, which supports safe and secure driving starts to be used. An effort to realize a wireless system at a frequency greater than 100 GHz is actively made.

In regard to second harmonic evaluation of a wireless system in a 60 to 70 GHz band or evaluation of a radio signal a frequency band over 100 GHz, as the frequency becomes high, the noise level of a measurement device and conversion loss of a mixer increase and frequency precision is lowered. For this reason, a high-sensitivity and high-precision measurement technology of a radio signal over 100 GHz has not been established. In the conventional measurement technologies, it is not possible to separate harmonics of local oscillation from the measurement result, and there is difficulty in strict measurement of unnecessary emission or the like.

In order to overcome the problems in the related art and to realize high-sensitivity and high-precision measurement of a radio signal in a frequency band greater than 100 GHz, it is necessary to develop a narrowband filter technology of a millimeter waveband for the purpose of suppressing an image response and a high-order harmonic response, and in particular, there is a demand for a technology which is adaptable to a variable frequency type (tunable).

Hitherto, as a filter which is used as a frequency variable type in a millimeter waveband, (a) a filter using a YIG resonator, (b) a filter with a varactor diode attached to a resonator, and (c) a Fabry-Perot resonator are known.

As the filter using a YIG resonator of (a), a filter which can be used up to about 80 GHz is known in the present situation, and as the filter with a varactor diode attached to a resonator of (b), a filter which can be used up to about 40 GHz is known. Meanwhile, manufacturing is difficult at a frequency over 100 GHz.

In contrast, the Fabry-Perot resonator of (c) is well used in an optical field, and a technology which uses the Fabry-Perot resonator for millimeter waves is disclosed in Non-Patent Document 1. Non-Patent Document 1 describes a confocal Fabry-Perot resonator in which a pair of spherical mirrors reflecting millimeter waves are arranged to face each other at the same interval as the radius of curvature, thereby realizing high Q.

RELATED ART DOCUMENT

Non-Patent Document

[Non-Patent Document 1] Tasuku Teshirogi and Tsutomu Yoneyama, "Modern millimeter-wave technologies", Ohmsha, 1993, p71

SUMMARY OF THE INVENTION

Problem that the Invention is to Solve

However, in the confocal Fabry-Perot resonator, when the distance between the mirror surfaces is moved so as to tune a passband, it is expected that, in principle, the focus is shifted and then Q is significantly lowered. Accordingly, a pair of mirrors which are different in curvature depending on the frequency should be selectively used.

As a Fabry-Perot resonator which is used in the optical field, a structure in which flat half mirrors are arranged to face each other is known. With this structure, in principle, even if the distance between the mirror surfaces is changed, Q is not lowered. Meanwhile, in order to realize a filter using the flat Fabry-Perot resonator in a millimeter waveband, there are the following problems which should be solved.

(A) It is necessary to input plane waves in parallel to the half mirrors. When an input to the filter is a waveguide, it is considered that the size becomes large like a horn antenna to realize plane waves, the size increases. In this case, it is difficult to realize complete plane waves, and characteristics are deteriorated.

(B) The half mirrors should have a function of transmitting a given amount of plane waves directly. For this reason, there are restrictions on the structure of the half mirrors, and a degree of freedom for design is low.

(C) Since the filter is of an open type, loss by space emission is large.

As a millimeter waveband filter which solves the above-described problem, as shown in FIG. 9, a structure is considered in which, inside a transmission line 1*a* which is formed by a waveguide 1 allowing electromagnetic waves in a predetermined frequency range of a millimeter waveband to propagate from one end to the other end in a TE10 mode, a pair of flat electric wave half mirrors 2 and 3 having characteristics to transmit a part of the electromagnetic waves in the predetermined frequency range and to reflect a part of the electromagnetic waves are arranged to face each other at an interval, and frequency components centering on the resonance frequency of a resonator formed between the pair of electric wave half mirrors are selectively transmitted.

With the above-described structure, it is possible to suppress characteristic deterioration by wavefront conversion, to give a high degree of freedom for deign of the electric wave half mirrors, and to reduce loss by space emission.

The electrical length between the pair of electric wave half mirrors 2 and 3 is changed, whereby the resonance frequency of the resonator can be variable. For this reason, it is preferable to use a mechanism which varies the interval of the pair of the electric wave half mirrors.

On the other hand, when actually manufacturing a frequency variable type millimeter waveband filter based on the above-described principle, there are other problems which should be solved.

That is, when realizing a mechanism which varies the interval between the pair of electric wave half mirrors 2 and 3, as shown in FIG. 10, a structure is made in which a first waveguide 11 allows electromagnetic waves in a predetermined frequency range to propagate in a TE10 mode, a second waveguide 12 has a first transmission line 12*a* which receives one end of the first waveguide 11 therein at a gap from the outer circumference of the first waveguide 11 and a second transmission line 12*b* which has the same inner size as the transmission line 11*a* of the first waveguide 11 and is arranged concentrically and successively to the first transmission line 12*a*, the first waveguide 11 and the second waveguide 12 can be relatively moved in the length direction of the transmission line, the electric wave half mirror 2 is fixed to the leading end of the transmission line 11*a* of the first waveguide 11, and the electric wave half mirror 3 is fixed to an end portion of the second transmission line 12*b* of the second waveguide 12 close to the first transmission line 12*a*.

In order to allow smooth relative movement of the first waveguide 11 and the second waveguide 12, it is preferable that the cap G between the outer circumferential wall of the first waveguide 11 and the inner circumferential wall of the first transmission line 12*a* of the second waveguide 12 is large. Meanwhile, if the gap G is large, electromagnetic waves which reciprocate between the half mirrors leak to the outside, and characteristics as a filter are considerably lowered. For this reason, it is necessary to make the gap G as small as possible.

For example, in a case of a waveguide having a size of about 2 millimeters×1 millimeter, the allowable gap G is equal to or smaller than 20 μm, and this dimension should be confirmed by a microscope. On the other hand, like the second waveguide 12 having the above-described structure, in a structure in which the leading end of the first waveguide 11 is set inside the first transmission line 12*a* on a large size side, it is not possible to observe the portion of the gap G from the outside and to confirm variation in the gap G, making it very difficult to position the first waveguide 11 and the second waveguide 12.

It takes a lot of time to form the two transmission lines 12*a* and 12*b* having different sizes concentrically and successively in a single member, and to fix the electric wave half mirror 3 to the boundary portion of the transmission lines, and variation is likely to occur from the viewpoint of processing precision, causing characteristic degradation in filter characteristics.

Accordingly, as the second waveguide, as shown in FIG. 11, a structure in which a small-size waveguide 16 is inserted into a large-size waveguide 15 and fixed is considered. In this case, the gap G between the outer circumferential wall of the first waveguide 11 and the inner circumferential wall of the large-size waveguide 15 can be confirmed before the small-size waveguide 16 is inserted.

However, in this insertion structure, a gap is required between the inner circumference of the large-size waveguide 15 and the outer circumference of the small-size waveguide 16 for positioning, the small-size waveguide 16 is inclined with respect to the large-size waveguide 15 by the gap, parallelism between the pair of electric wave half mirrors 2 and 3 is degraded due to the inclination, and selection characteristics of the filter are deteriorated.

The invention has been accomplished in order to solve these problems, and an object of the invention is to provide a millimeter waveband filter and a method of manufacturing the same capable of suppressing characteristic deterioration by wavefront conversion, giving a high degree of freedom for design of electric wave half mirrors, reducing loss by space emission, allowing high-precision mechanical positioning necessary for frequency variation, and maintaining high characteristics as a filter.

Means for Solving the Problem

In order to attain the above-described object, a frequency variable type millimeter waveband filter according to an aspect of the invention includes a first waveguide which has a transmission line having a size allowing electromagnetic waves in a predetermined frequency range of a millimeter waveband to propagate in a TE10 mode.

a second waveguide which is formed such that a first transmission line which has a size greater than the outer size of the first waveguide allowing the electromagnetic waves in the predetermined frequency range to propagate in the TE10 mode and receives one end of the first waveguide at a gap from the outer circumference of the first waveguide and a second transmission line having the same size as the transmission line of the first waveguide are arranged concentrically and successively, and a pair of electric wave half mirrors which have characteristics to transmit a part of the electromagnetic waves in the predetermined frequency range and to reflect a part of the electromagnetic waves, one of the electric wave half mirrors being fixed to the transmission line of the first waveguide, and the other electric wave half mirror being fixed to the second transmission line of the second waveguide, in which the first waveguide is relatively moved with respect to the second waveguide such that the interval between the pair of electric wave half mirrors is changed, and an electromagnetic wave at a resonance frequency to be determined by the interval of the pair of electric wave half mirrors from among the electromagnetic waves in the predetermined frequency range is selectively transmitted, the second waveguide includes a first transmission line forming body which has a plate-shaped portion having a uniform thickness, the plate-shaped portion having a through hole which is formed in a thickness direction to form the first transmission line, a second transmission line forming body which has a plate-shaped portion having a uniform thickness, the plate-shaped portion having a through hole which is formed in a thickness direction to form the second transmission line, and the first transmission line forming body and the second transmission line forming body are formed in a state where the plate-shaped portions overlap each other such that the through holes are arranged concentrically and successively.

According to a second aspect of the invention, in the millimeter waveband filter according to the first. aspect of the invention, a choke forming body which has a plate-shaped portion overlapping the plate-shaped portion of the second transmission line forming body on an opposite side with the plate-shaped portion of the first transmission line forming body interposed therebetween is provided, a hole which allows the first waveguide to pass therethrough at a gap is formed to pass through the plate-shaped portion in a thickness direction, and a groove having a predetermined depth for electromagnetic wave leakage prevention is formed round along the inner circumference of the hole.

According to a third aspect of the invention, in the millimeter waveband filter according to the first aspect of the invention, an air duct is provided to extend from the edge of the square hole forming the first transmission line of the first transmission line forming body to the outer circumferential surface of the first transmission line forming body through the bonded surface of the plate-shaped portions of the first transmission line forming body and the second transmission line forming body.

According to a fourth aspect of the invention, there is provided a method of manufacturing a millimeter waveband filter, in which the millimeter waveband filter includes a first waveguide which has a transmission line having a size allowing electromagnetic waves in a predetermined frequency range of a millimeter waveband to propagate in a TE10 mode, a second waveguide which is formed such that a first transmission line which has a size greater than the outer size of the first waveguide allowing the electromagnetic waves in the predetermined frequency range to propagate in the TE10 mode and receives one end of the first waveguide at a gap from the outer circumference of the first waveguide and a second transmission line having the same size as the transmission line of the first waveguide are arranged concentrically and successively, and a pair of electric wave half mirrors which have characteristics to transmit a part of the electromagnetic waves in the predetermined frequency range and to reflect a part of the electromagnetic waves, one of the electric wave half mirrors being fixed to the transmission line of the first waveguide, and the ether electric wave half mirror being fixed to the second transmission line of the second waveguide, the first waveguide is relatively moved with respect to the second waveguide such that the interval between the pair of electric wave half mirrors is changed, and an electromagnetic wave at a resonance frequency to be determined by the interval of the pair of electric wave half mirrors from among the electromagnetic waves in the predetermined frequency range is selectively transmitted, and the method includes the steps of forming a square hole forming the first transmission line in a plate-shaped portion having a uniform thickness to pass through the plate-shaped portion in a thickness direction to prepare a first transmission line forming body as a part of the second waveguide, forming a square hole forming the second transmission line in a plate-shaped portion having a uniform thickness to pass through the plate-shaped portion in a thickness direction to prepare a second transmission line forming body as a part of the second waveguide, specifying a position where the square holes provided in the plate-shaped portions of the first transmission line forming body and the second transmission line forming body are arranged concentrically and successively, performing positioning such that the gap between the outer circumference of the first waveguide and the inner circumference of the first transmission line of the first transmission line forming body becomes uniform, and fixing the second transmission line forming body at the specified position with respect to the first transmission Line forming body positioned with respect to the first waveguide.

Advantage of the Invention

As described above, the millimeter waveband filter of the invention has the following structure. In the first waveguide, one of the pair of electric wave half mirrors is fixed to the transmission line, and in the second waveguide, the first transmission line which receives one end of the first waveguide at the gap from the outer circumference of the first waveguide and the second transmission line which has the same size as the transmission line of the first waveguide and to which the other electric wave half mirror is fixed are arranged concentrically and successively. The second waveguide is relatively moved with respect to the first waveguide such that the interval between the pair of electric wave half mirrors is changed, and the electromagnetic wave at the resonance frequency to be determined by the interval between the electric wave half mirrors is selectively transmitted. The second waveguide has a structure in which the first transmission line forming body has the square hole forming the first transmission line in the plate-shaped portion having a uniform thickness to pass through the plate-shaped portion in the thickness direction, the second transmission line forming body has the square hole forming the second transmission line in the plate-shaped portion having a uniform thickness to pass through the plate-shaped portion in the thickness direction, and the first transmission line forming body and the second transmission line forming body are connectable and separable in a state where the plate-shaped portions overlap each other such that the square holes are arranged concentrically and successively.

In this way, a resonator having a pair of flat electric wave half mirrors is provided inside the successive transmission lines which transmit only the TE10 mode. For this reason, a special device for inputting plane waves is not required, and the electric wave half mirrors do not need to transmit plane waves and may have an arbitrary shape.

The filter is of a closed type as a whole, and there is no loss by emission to the external space in principle, whereby very high selection characteristics can be realized in the millimeter waveband.

The second waveguide is formed such that the first transmission line forming body and the second transmission line forming body are connectable and separable in a state where the plate-shaped portions overlap each other. For this reason, it is possible to observe the gap between the outer circumference of the first waveguide and the square hole forming the first transmission line from the first transmission line forming body side, and to accurately perform the positioning. After the positioning, if the second transmission line forming body is connected to the first transmission line forming body such that the plate-shaped portions overlap each other at the positions positioned in advance, the second transmission line is not inclined with respect to the first transmission line, and it is possible to accurately perform the positioning of the three transmission lines and to maintain high filter characteristics.

In a structure in which the first transmission line forming body and the choke forming body overlap each other, and a groove for electromagnetic wave leakage prevention is formed, it is possible to suppress leakage of electromagnetic waves from the gap between the outer circumference of the first waveguide and the inner circumference of the first transmission line of the second waveguide, thereby preventing degradation in filter characteristics by the gap.

In a structure in which the air duct is provided, it is possible to prevent distortion of the electric wave half mirror by air pressure at the time of frequency variation, thereby stably performing frequency variation.

According to the method of manufacturing a millimeter waveband filter of the invention, in regard to the first transmission line forming body and the second transmission line forming body in which the square holes forming the transmission lines are formed to pass through the plate-shaped portions, the position where the square holes are arranged concentrically and successively is specified, the first waveguide and the first transmission line forming body are positioned such that the gap therebetween is uniform, the second transmission line forming body is fixed to the positioned first transmission line forming body at the specified position. Therefore, it is possible to perform smooth frequency variation by the uniform gap and to arrange the three successive transmission lines accurately and concentrically, thereby obtaining a filter having excellent characteristics.

MODE FOR CARRYING OUT THE INVENTION

Hereinafter, an embodiment of the invention will be described.

Figure 1A:
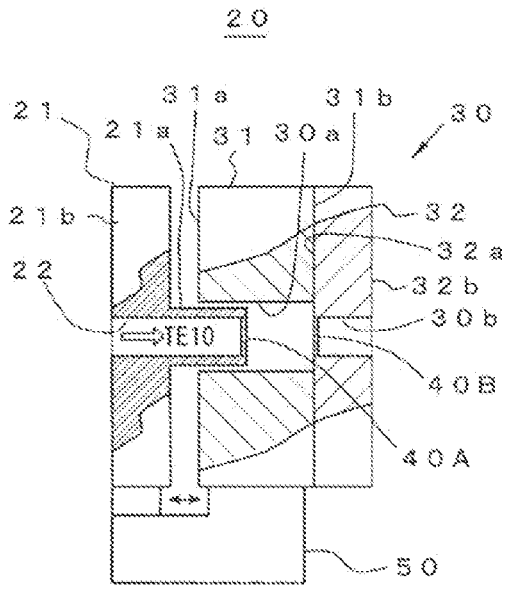
FIGS. 1A and 1B are diagrams showing the basic structure of a millimeter waveband filter of the invention.
Figure 1B:
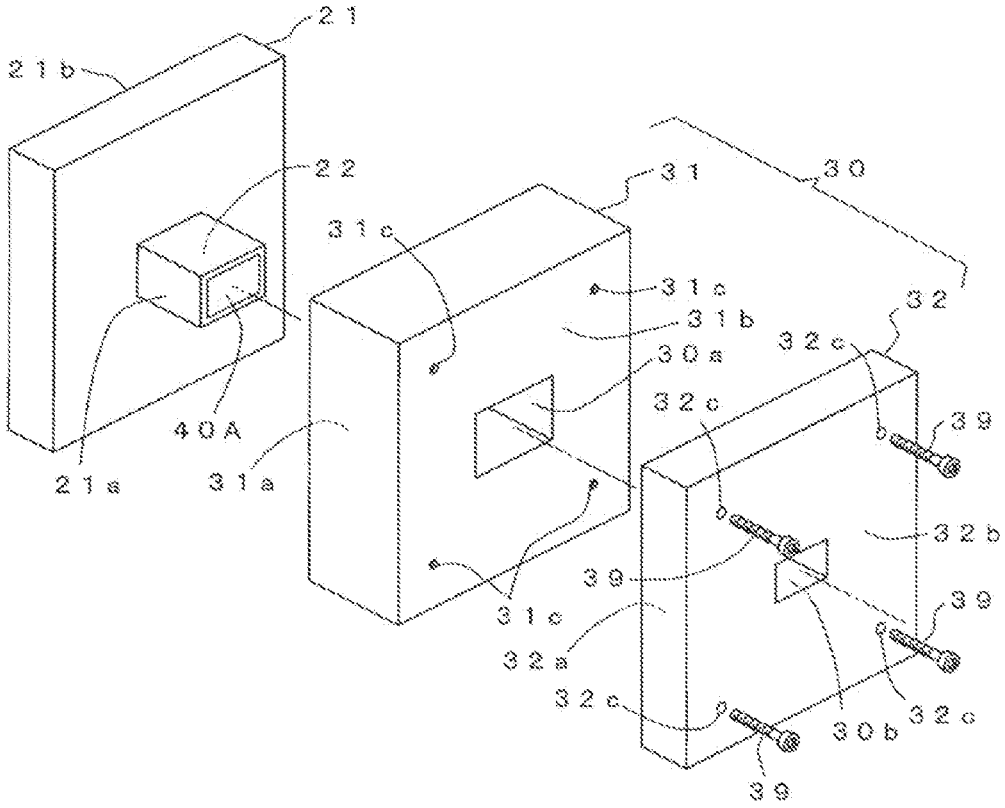

FIGS. 1A and 1B show the basic structure of a millimeter waveband filter 20 of the invention.

As shown in side view of FIG. 1A, a millimeter waveband filter 20 has a first waveguide 21, a second waveguide 30, a pair of electric wave half mirrors 40A and 40B, and a support mechanism 50.

The first waveguide 21 has as square cylindrical portion 21*a* and a flange 21*b* provided at one end of the square cylindrical portion 21*a*. Inside the square cylindrical portion 21*a*, a transmission line 22 which has a size (for example, a size of a×b=2.032 mm×1.016 mm) allowing electromagnetic waves in a predetermined frequency range (for example, 110 to 140 GHz) of a millimeter waveband to propagate in a TE10 mode (single mode) is formed from one end to the other end.

The second waveguide 30 is formed such that a first transmission line 30*a* which has a size slightly (for example, 20 μm vertically and horizontally) greater than the outer size of the square cylindrical portion 21*a* of the first waveguide 21 allowing the electromagnetic waves in the predetermined frequency range to propagate in the TE10 mode and concentrically receives the leading end of the receives first waveguide 21 at a substantially uniform gap from the outer circumference of the first waveguide 21 and a second transmission line 30*b* which substantially has the same size as the transmission line 22 of the first waveguide 21 are arranged concentrically and successively in a state free from twist.

An electric wave half mirror 40A which has characteristics to transmit a part of the electromagnetic waves in the predetermined frequency range and to reflect a part of the electromagnetic waves is fixed to the leading end portion of the first waveguide 21 in a state of blocking the transmission line 22. An electric wave half mirror 40B which is paired with the electric wave half mirror 40A is fixed to the leading end of the second transmission line 30*b* of the second waveguide 30.

Figure 2:
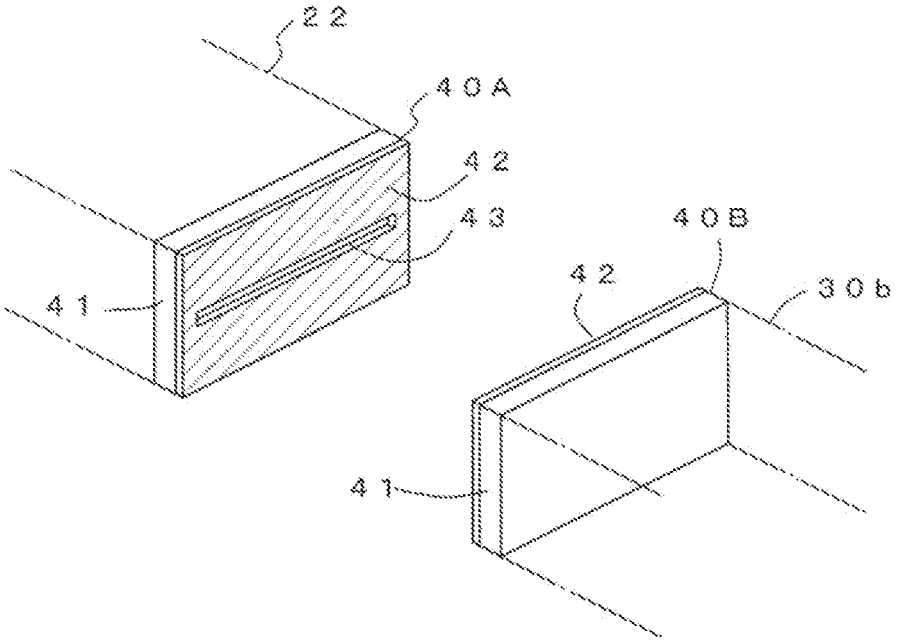
FIG. 2 is a diagram showing a structure example of an electric wave half mirror.

For example, as shown in FIG. 2, each of a pair of electric wave half mirrors 40A and 40B has a rectangular dielectric substrate 41 which is of size corresponding to the size of each of the transmission lines 22 and 30*b*, a metal film 42 which covers the surface of the dielectric substrate 41, and an electromagnetic wave transmitting slit 43 which is provided in the metal film 42. Each of the electric wave half mirrors 40A and 40B is fixed to the leading end portion of each of the transmission lines in a state where the outer circumference of the metal film 42 is in contact with the inner wall or the leading edge of each of the transmission lines 22 and 30*b*, and transmits the electromagnetic waves with transmittance corresponding to the shape or area of the slit 43.

In the millimeter waveband filter 20 having this structure, a flat Fabry-Perot resonator which resonates with the interval of a pair of opposing electric wave half mirrors 40A and 40B (strictly, an electrical length taking into consideration a dielectric constant or the like of a dielectric between the two metal films 42) as a half wavelength, and only frequency components centering on the resonance frequency can be selectively transmitted.

Each of the transmission lines 22, 30*a*, and 30*b* has a waveguide structure as a closed transmission path with very low loss in the millimeter waveband, and uses TE waves in which an electric field is present only in a plane perpendicular to a traveling direction. For this reason, processing, such as wavefront conversion, is not required, and only a signal component extracted by the resonator can be output in the TE10 mode with very low loss.

The first waveguide 21 and the second waveguide 30 are supported by the support mechanism 50 such that the transmission lines 22, 30*a*, and 30*b* are arranged concentrically and successively in a state free from twist, and the interval between a pair of electric wave half mirrors 40A and 40B can be variable while a pair of electric wave half mirrors 40A and 40B are arranged in parallel to face each other. The support mechanism 50 includes a mechanism which solidly supports both the waveguides 21 and 30, and a mechanism which relatively moves both the waveguides 21 and 30 in the length direction of the transmission line such that the interval of a pair of electric wave half mirrors 40A and 40B is changed, and the configuration thereof is arbitrary.

In this way, the transmission line which transmits only the TE10 mode is successive, and a resonator having a pair of flat electric wave half mirrors 40A and 40B is provided inside the transmission line. For this reason, a special device for inputting plane waves is not required, and the electric wave half mirrors do not need to transmit plane waves and can have an arbitrary shape.

The filter is of a closed type as a whole, and loss by emission to the external space is low, whereby very high selection characteristics can be realized in the millimeter waveband.

In the millimeter waveband filter 20 of this embodiment, as shown in FIG. 1B, the second waveguide 30 is formed such that a first transmission line forming body 31 has a plate shape having a uniform thickness and has a square hole forming the first transmission line 30*a* to pass therethrough from one surface 31*a* to an opposite surface 31*b*, a second transmission line, forming body 32 has a plate shape having a uniform thickness and has a square hole forming the second transmission line 30*b* to pass therethrough from one surface 32*a* to an opposite surface 32*b*, the first transmission line forming body 31 and the second transmission line forming body 32 are connectable and separable by screws or the like in a state of overlapping each other such that the square holes are arranged concentrically and successively. In the drawing, reference numeral 31*c* denotes a screw fastening hole, reference numeral 32*c* denotes a screw passing-through hole, and reference numeral 39 denotes a connecting screw.

Here, although as a simplest shape example, an example where the first transmission line forming body 31 and the second transmission line forming body 32 are plate bodies having a uniform thickness, the shape of the outer circumferential portion is arbitrary insofar as portions of the plate-shaped portions in which the square holes forming the transmission lines 30*a* and 30*b* are formed to pass therethrough have a uniform thickness, and the bodies are connectable and separable in a state where the plate-shaped portions overlap each other.

In this way, the second waveguide 30 has a structure in which the plate-shaped bodies with transmission lines having a single size passing therethrough in the thickness direction are arranged to overlap each other and connected as a single body. For this reason, it is possible to accurately manufacture the first transmission line 30*a* and the second transmission line 30*b* having different sizes in different members, and to easily specify an overlapping position in a state where the first transmission line 30*a* and the second transmission line 30*b* are arranged concentrically and successively, and to realize the high-precision second waveguide 30. Since an operation to fix the electric wave half mirror 40B to the leading end of the second transmission line 30*b* is performed in the surface of the plate body, it is possible to very easily perform the operation and to allow fixing in a correct posture.

Before the second transmission line forming body 32 is fixed to the first transmission line forming body 31, when observing the square hole portion from the opposite surface 31*b* of the first transmission line forming body 31 by a microscope or the like in a state where the first waveguide 21 and the first transmission line forming body 31 are supported by the support mechanism 50, the gap G between the outer circumference of the first waveguide 21 and the inner circumference of the first transmission line 30*a* can be easily observed.

Figure 3:
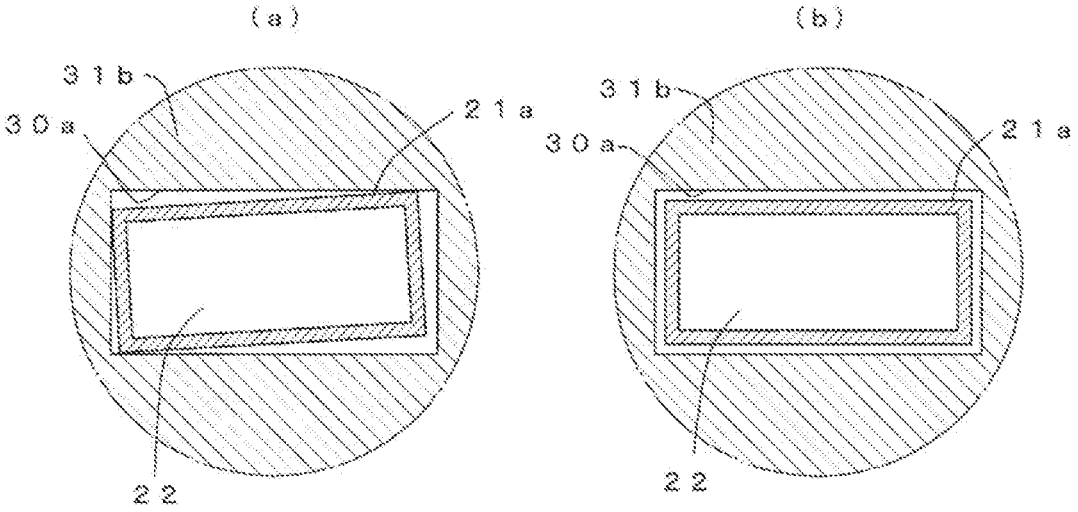
FIGS. 3A and 3B are explanatory views of a positioning operation of a waveguide.

For example, as shown in FIG. 3A, when an image in which the first waveguide 21 is inclined (twisted) eccentrically with respect to the first transmission line 30*a* is observed, the center position and the angle of the first waveguide 21 with respect to the first transmission line forming body 31 are adjusted by the support mechanism 50, and as shown in FIG. 3B, positioning is made such that the gap between both of them is uniform over the entire circumference (concentric and free from twist). Accordingly, it is possible to prevent the waveguides from being in contact with each other and to smoothly perform frequency variation in a state free from abrasion. After the positioning, if the second transmission line forming body 2 is fixed to the pre-specified position of the first transmission line forming body 31, it is possible to arrange the three successive transmission lines accurately and concentrically.

As described above, in a structure in which the first waveguide 21 is relatively moved with respect to the second waveguide 30, a gap is required between the outer circumferential wall of the first waveguide 21 and the inner circumferential wall of the first transmission line 30*a* of the second waveguide 30. However, since this gap is structurally successively connected to a resonator which is formed between a pair of electric wave half mirrors 40A and 40B, the electromagnetic waves in the resonator leak from the gap, causing characteristic degradation as a filter. For this reason, as described above, although a structure in which position adjustment between the waveguides at a small gap is performed is used, for example, even if the gap is suppressed to 20 μm, as described above, it is not possible to completely prevent leakage of the electromagnetic waves.

Figure 4A:
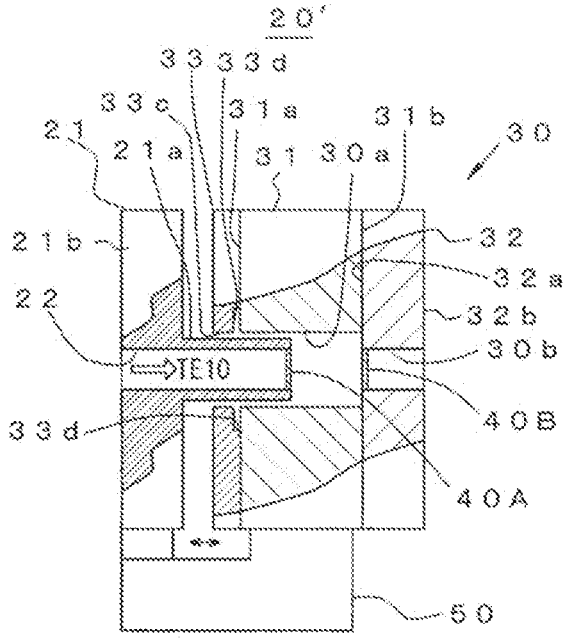
FIGS. 4A and 4B are configuration diagrams of a filter in which a groove for electromagnetic wave leakage prevention is provided.
Figure 4B:
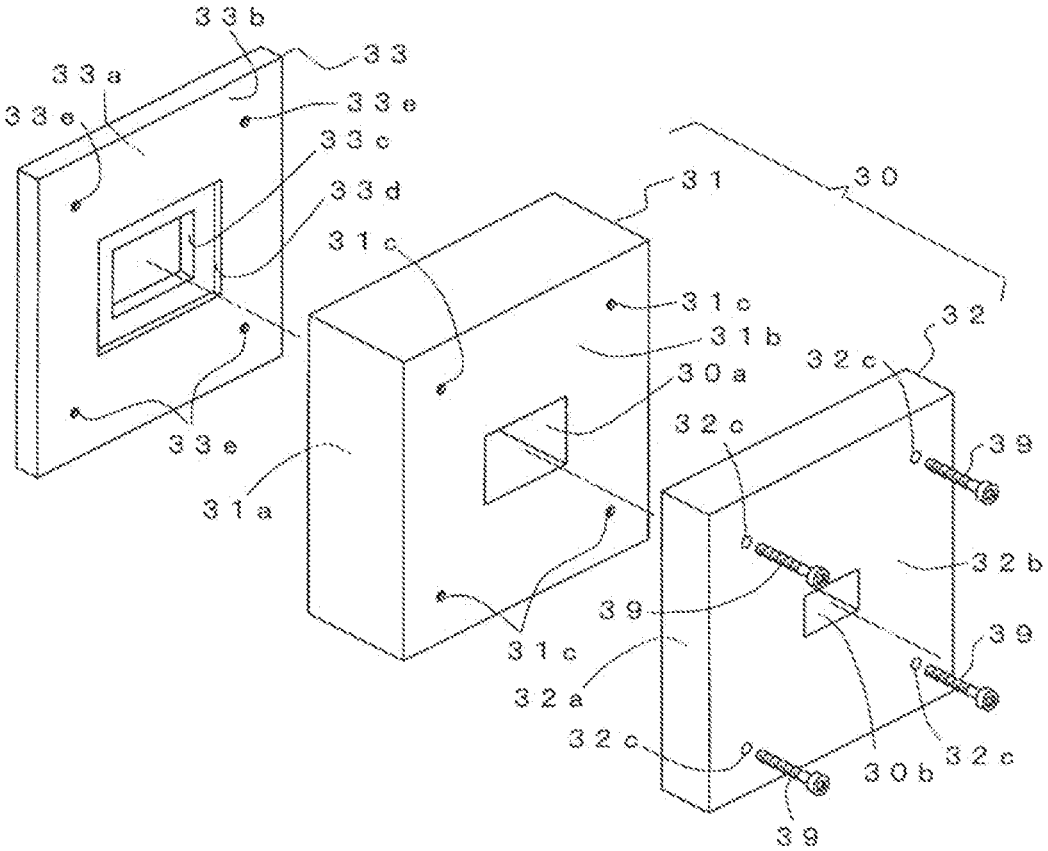

When characteristics such that leakage of the electromagnetic waves is not negligible are required, like a millimeter waveband filter 20' shown in a plan view of FIG. 4A and a main exploded perspective view of FIG. 4B, a choke forming body 33 which has a plate shape, is superimposed on one surface 31*a* of the first transmission line forming body 31, has a square hole 33*c* (here, the same size as the first transmission line 30*a* allowing the transmission of the first waveguide 21 at a gap to pass therethrough from one surface 33*a* to the other surface 33*b*, and has a groove (choke) 33*d* having a predetermined depth for electromagnetic wave leakage prevention formed round along the inner circumference of the square hole 33*c* may be provided so as to prevent leakage of the electromagnetic wave from the resonator. The choke forming body 33 may be fastened and fixed to the first transmission line forming body 31 from one surface 33*a* through, for example, screw holes 33*e* provided at four corners as shown in the drawing.

Figures 5, 6:
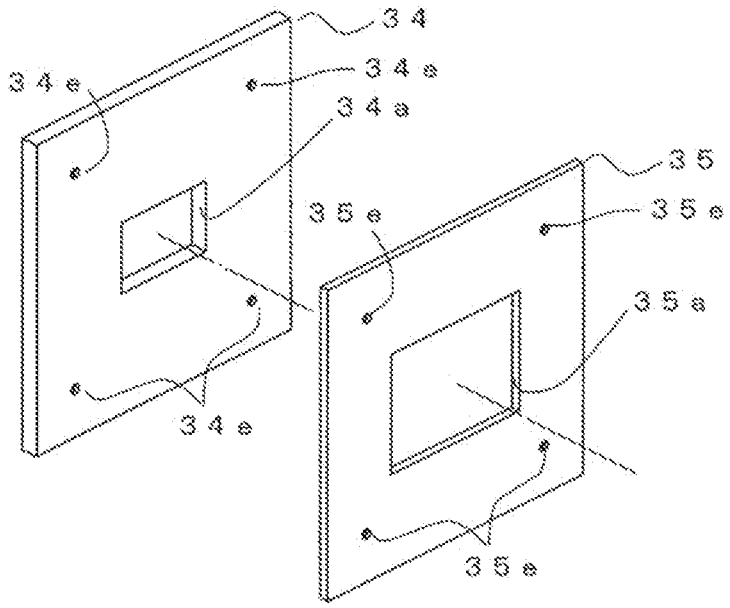
FIG. 5 is a diagram showing an example where a choke forming body has two plates.
FIG. 6 shows a simulation result which represents a characteristic difference of a filter depending on the presence/absence of a gap and the presence/absence of a groove.

Although the edge of the square hole 33*c* in the opposite surface 33*b* of the choke forming body 33 is cut out at a predetermine width and a predetermined depth to form the groove 33*d* for electromagnetic wave leakage prevention between the opposite surface 33*b* and one surface 31*a* of the first transmission line forming body 31, as shown in FIG. 5, a plate body 34 which has a square hole 34*a* having the same size as the first transmission line 30*a* and a plate body 35 which has a square hole 35*a* having a size greater than the first transmission line 30*a* by the depth of the groove 33*d* may overlap each other such that the square holes are arranged concentrically in a state free from twist, and this structure may be used as a choke forming body and concentrically fixed to the first transmission line forming body 31.

In order that the groove 33*d* has an electromagnetic wave leakage prevention function, it is preferable that the depth is set to be ¼ (for example, about 0.7 mm at 120 GHz) of the guide wavelength (λg) at a rejection frequency. It is preferable that the width is, for example, about 0.2 mm. When the rejection frequency is in a wideband, it is preferable that a plurality of grooves having different depths are formed at a predetermined interval.

Figure 7:
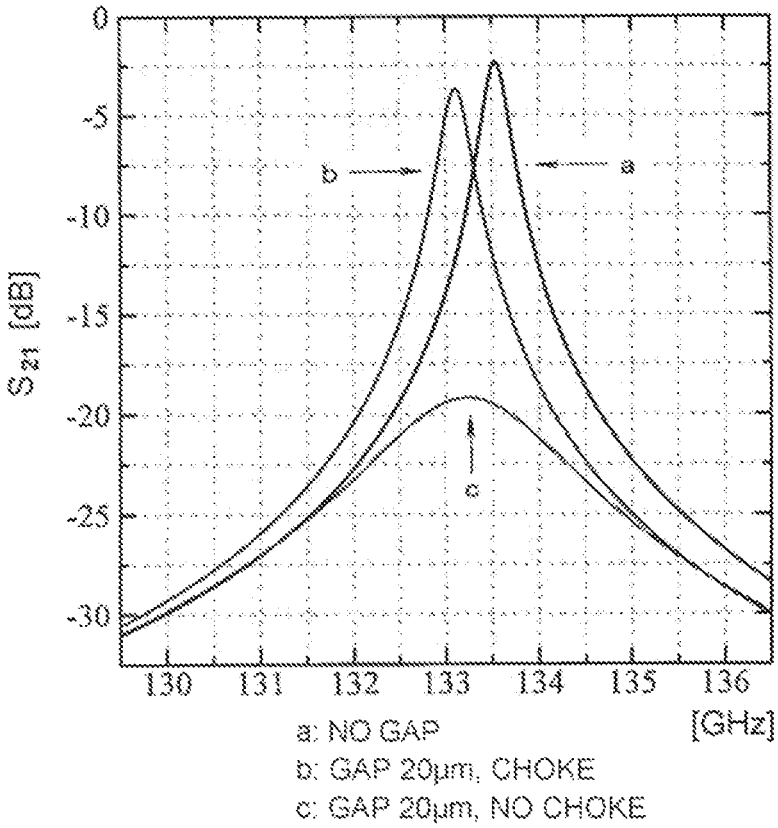
FIG. 7 shows a simulation result representing a difference in frequency characteristic of filter characteristics depending on the presence/absence of a gap and the presence/absence of a groove.

The results of simulations for confirming the electromagnetic wave leakage prevention function are shown in FIGS. 6 and 7. FIG. 6 shows the measurement results of a center frequency, insertion loss, 3 dB bandwidth, and Q in a: a state with no gap (ideal state), b: a state in which the gap is 20 μm and the groove 33*d* having a depth of 0.7 mm and a width of 0.2 mm is provided, and c: a state where the gap is 20 μm and no groove 33*d* is provided. FIG. 7 shows transmission characteristics when a frequency of an input signal is variable.

From these simulation results, when the gap is 20 μm and no groove is provided, it is understood that insertion loss is deteriorated by 16.85 dB, the bandwidth (selectivity) is deteriorated 3.4 times or more, and the Q value is lowered to 29 percent, compared to the ideal state. In contrast, when the gap is 20 μm and a groove is provided, it is understood that insertion loss is lowered only by 1.3 dB, the bandwidth (selectivity) is lowered only 1.2 times, and the Q value is lowered up to 81 percent, when a characteristic diagram of FIG. 7 is viewed, characteristics close to the ideal state are obtained, and even if a gap is provided, it is possible to suppress characteristic deterioration by the electromagnetic wave leakage prevention function of the groove 33*d*, compared to the ideal state.

As described above, if a narrow gap is provided, when the first waveguide 21 is relatively moved with respect to the second waveguide 30 at a comparatively high speed, the volume of the space between a pair of electric wave half mirrors 40A and 40B increases/decreases. Meanwhile, air in this space does not escape from the gap, the internal pressure changes, and the pressure causes distortion in the thin electric wave half mirrors 40A and 40B. For this reason, there is a possibility that the resonance frequency of the filter is deviated from a desired value, loss increases, or the like.

Figure 8A:
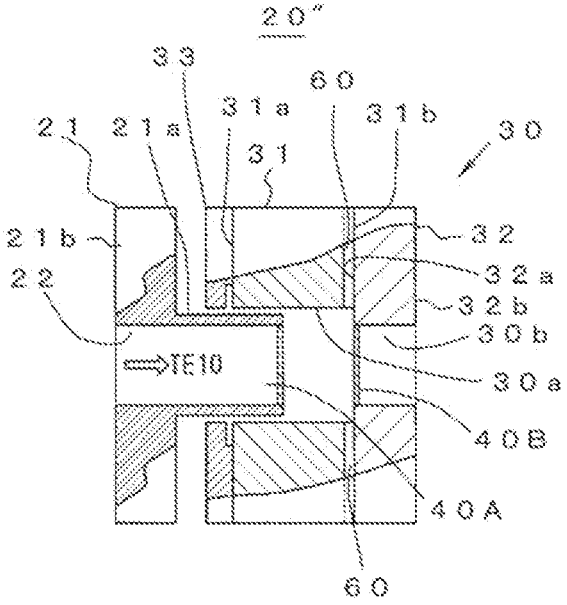
FIGS. 8A and 8B are structure diagrams of a filter in which an air duct is provided.
Figure 8B:
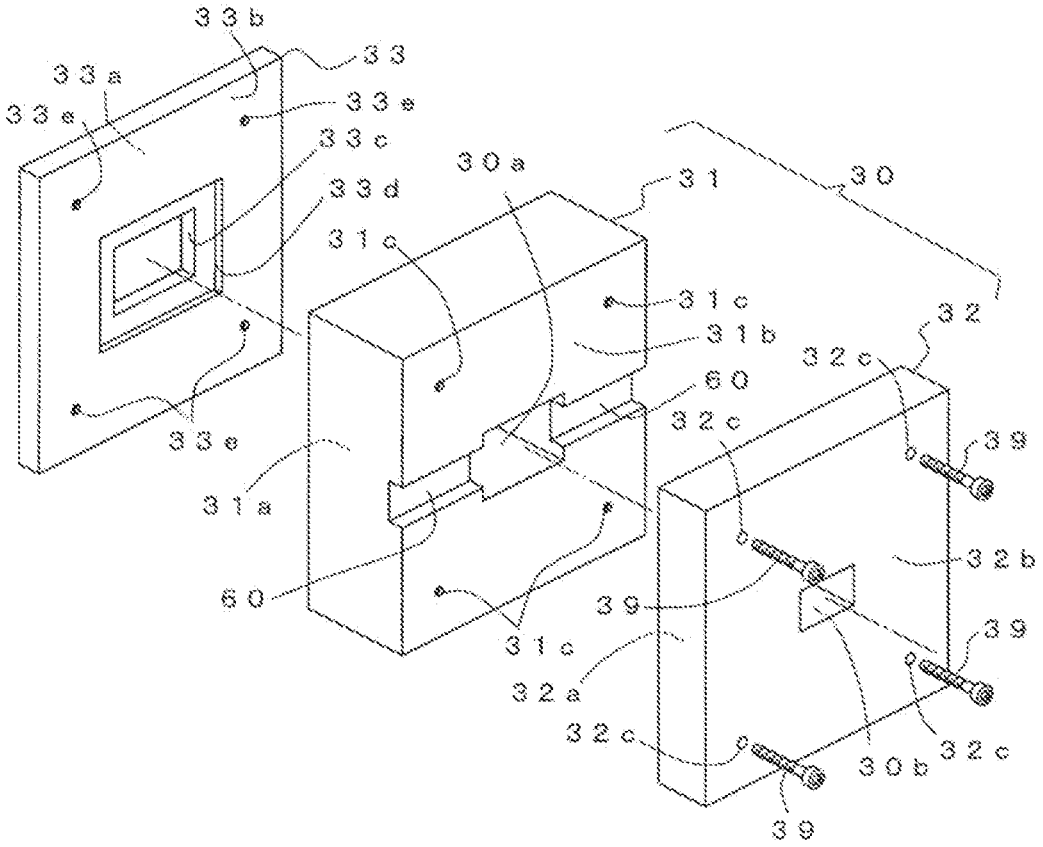
Figure 9:
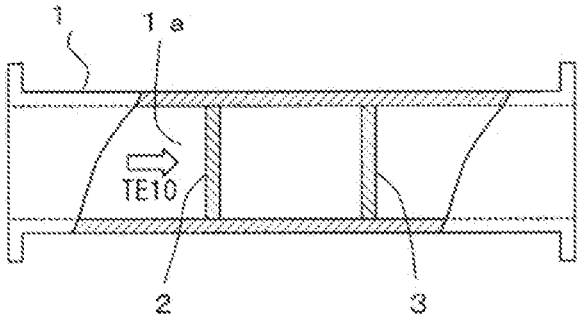
FIG. 9 is a principle structure diagram of a millimeter waveband filter which underlies the invention
Figure 10:
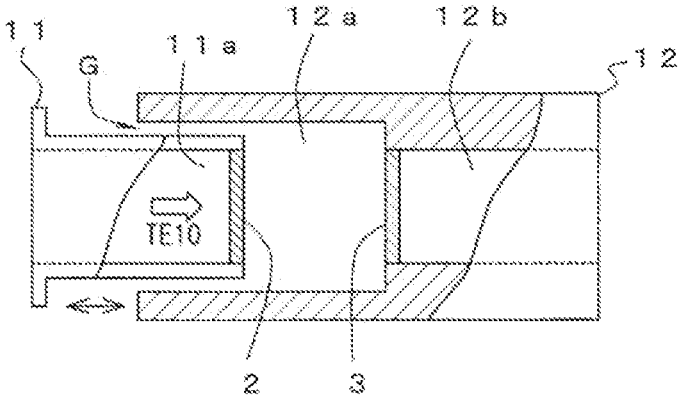
FIG. 10 shows a first structure example when realizing a millimeter waveband filter.
Figure 11:
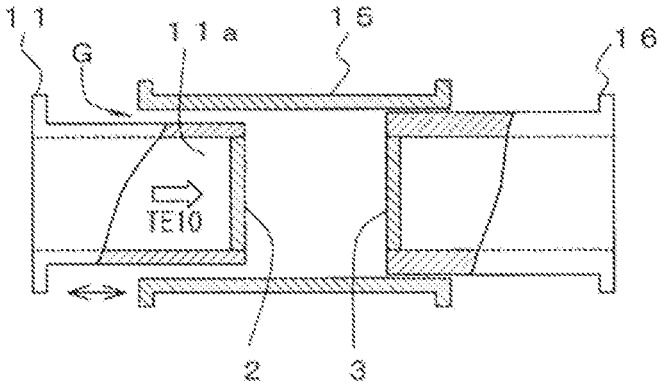
FIG. 11 shows a second structure example when realizing a millimeter waveband filter.

When the effect of the change in pressure on the filter characteristics is not negligible, like a millimeter waveband filter 20" shown in a plan view of FIG. 8A and a main exploded perspective view of FIG. 8B, an air duct 60 may be provided successively from the short edge of the square hole forming the first transmission line 30*a* of the first transmission line forming body 31 to the outer circumferential surface through the bonded surface of the first transmission line forming body 31 and the second transmission line forming body, such that air easily passes between the space between the electric wave half mirrors 40A and 40B and the outside.

The air duct 60 may be formed using a groove which is provided in at least one of the bonded surface of the first transmission line forming body 31 and the second transmission line forming body 32. As described above, although the effect on the filter characteristics is a concern because the edge of the transmission line 30*a* is cut, it is known that there is less effect of the chance in shape of the short side of the rectangular transmission line compared to the long side of the transmission line. When electromagnetic wave leakage by the air duct 60 is not negligible, the groove for electromagnetic wave leakage prevention having a predetermined depth may be provided in the inner wall of the air duct 60, thereby suppressing the leakage of the electromagnetic waves.

DESCRIPTION OF REFERENCE NUMERALS AND SIGNS

20, 20', 20": millimeter waveband filter, 21: first waveguide, 22: transmission line, 30: second waveguide, 30*a:* first transmission line, 30*b:* second transmission line, 31: first transmission line forming body, 32: second transmission Line forming body, 33: choke forming body, 33*d:* groove, 40A, 40B: electric wave half mirror, 50: support mechanism, 60: air duct

The invention claimed is:

1. A frequency variable type millimeter waveband filter comprising:

a first waveguide which has a transmission lane having a size allowing electromagnetic waves in a predetermined frequency range of a millimeter waveband to propagate in a TE10 mode;

a second waveguide which is formed such that a first transmission line which has a size greater than the outer size of the first waveguide allowing the electromagnetic waves in the predetermined frequency range to propagate in the TE10 mode and receives one end of the first waveguide at a gap from the outer circumference of the first waveguide and a second transmission line having the same size as the transmission line of the first waveguide are arranged concentrically and successively; and a pair of electric wave half mirrors which have characteristics to transmit at part of the electromagnetic waves in the predetermined frequency range and to reflect a part of the electromagnetic waves, one of the electric wave half mirrors being fixed to the transmission line of the first waveguide, and the other electric wave half mirror being fixed to the second transmission line of the second waveguide, wherein the first waveguide is relatively moved with respect to the second waveguide such that the interval between the pair of electric wave half mirrors is changed, and an electromagnetic wave at a resonance frequency to be determined by the interval of the pair of electric wave half mirrors from among the electromagnetic waves in the predetermined frequency range is selectively transmitted, the second waveguide includes a first transmission line forming body which has a plate-shaped portion having a uniform thickness, the plate-shaped portion having a through hole which is formed in a thickness direction to form the first transmission line, and a second transmission line forming body which has a plate-shaped portion having a uniform thickness, the plate-shaped portion having a through hole which is formed in a thickness direction to form the second transmission line, and the first transmission line forming body and the second transmission line forming body are formed in a state where the plate-shaped portions overlap each other such that the through holes are arranged concentrically and successively.

2. The millimeter waveband filter according to claim 1, wherein a choke forming body which has a plate-shaped portion overlapping the plate-shaped portion of the second transmission line forming body on an opposite side with the plate-shaped portion of the first transmission line forming body interposed therebetween is provided, a hole which allows the first waveguide to pass there through at a gap is formed to pass through the plate-shaped portion in a thickness direction, and a groove having a predetermined depth for electromagnetic wave leakage prevention is formed round along the inner circumference of the hole.

3. The millimeter waveband filter according to claim 1, wherein an air duct is provided to extend from the edge of the square hole forming the first transmission line of the first transmission line forming body to the outer circumferential surface of the first transmission line forming body through the bonded surface of the plate-shaped portions of the first transmission line forming body and the second transmission line forming body.

4. A method of manufacturing a frequency variable type millimeter waveband filter, wherein the millimeter waveband filter includes a first waveguide which has a transmission line having a size allowing electromagnetic waves in a predetermined frequency range of a millimeter waveband to propagate in a TE10 mode, a second waveguide which is formed such that a first transmission line which has a size greater than the outer size of the first waveguide allowing the electromagnetic waves in the predetermined frequency range to propagate in the TE10 mode and receives one end of the first waveguide at a gap from the outer circumference of the first waveguide and a second transmission line having the same size as the transmission line of the first waveguide are arranged concentrically and successively, and a pair of electric wave half mirrors which have characteristics to transmit a part of the electromagnetic waves in the predetermined frequency range and to reflect a part of the electromagnetic waves, one of the electric wave half mirrors being fixed to the transmission line of the first waveguide, and the other electric wave half mirror being fixed to the second transmission line of the second waveguide, the first waveguide is relatively moved with respect to the second waveguide such that the interval between the pair of electric wave half mirrors is changed, and an electromagnetic wave at a resonance frequency to be determined by the interval of the pair of electric wave half mirrors from among the electromagnetic waves in the predetermined frequency range is selectively transmitted, and the method comprises the steps of:

forming a square hole forming the first transmission line in a plate-shaped portion having a uniform thickness to pass through the plate-shaped portion in a thickness direction to prepare a first transmission line forming body as a part of the second waveguide;

forming a square hole forming the second transmission line in a plate-shaped portion having a uniform thickness to pass through the plate-shaped portion in a thickness direction to prepare a second transmission line forming body as a part of the second waveguide;

specifying a position where the square holes provided, in the plate-shaped portions of the first transmission line forming body and the second transmission line forming body are arranged concentrically and successively;

performing positioning such that the gap between the outer circumference of the first waveguide and the inner circumference of the first transmission line of the first transmission line forming body becomes uniform; and fixing the second transmission line forming body at the specified position with respect to the first transmission line forming body positioned with respect to the first waveguide.

* * * * *